US007395986B1

(12) United States Patent
Haering

(10) Patent No.: US 7,395,986 B1
(45) Date of Patent: Jul. 8, 2008

(54) DISPENSER FOR READILY ATTACHING TO A ROLE-TYPE TOILET-TISSUE HOLDER AND DISPENSING MOIST TOWELETTES FROM A ROLE

(76) Inventor: Ernest L. Haering, 30 Waterside Plz., Apt. 22B, New York, NY (US) 10010

( * ) Notice: Subject to any disclaimer, the term of this patent is extended or adjusted under 35 U.S.C. 154(b) by 0 days.

(21) Appl. No.: 11/804,171

(22) Filed: May 17, 2007

(51) Int. Cl.
*B65H 75/18* (2006.01)

(52) U.S. Cl. ..... 242/599.3; 242/598.6

(58) Field of Classification Search ..... 242/598.6, 242/598, 598.3, 599.3, 599.4, 588.3, 588.6
See application file for complete search history.

(56) References Cited

U.S. PATENT DOCUMENTS

| | | | | |
|---|---|---|---|---|
| 573,563 | A | 12/1896 | Yeakel | |
| 2,649,255 | A | 8/1953 | Smallen | |
| 3,184,053 | A | 5/1965 | Eldridge | |
| 3,310,353 | A * | 3/1967 | Cordis | |
| 3,756,483 | A | 9/1973 | Schraider | |
| 3,843,017 | A | 10/1974 | Harrison | |
| 3,995,582 | A | 12/1976 | Douglas | |
| 4,004,687 | A | 1/1977 | Boone | |
| D245,225 | S | 8/1977 | Lyons | |
| 4,106,616 | A | 8/1978 | Boone | |
| 4,235,333 | A | 11/1980 | Boone | |
| 4,239,164 | A | 12/1980 | Barnsbee et al. | |
| 4,535,912 | A | 8/1985 | Bonk | |
| D285,995 | S | 10/1986 | Minost | |
| 5,439,521 | A * | 8/1995 | Rao | 242/598.6 |
| 5,660,313 | A * | 8/1997 | Newbold | 242/598.6 |
| 5,697,577 | A * | 12/1997 | Ogden | 242/598.6 |
| 6,056,235 | A * | 5/2000 | Brozinsky | 242/598.6 |
| 6,098,836 | A | 8/2000 | Gottselig | |
| 6,536,707 | B2 * | 3/2003 | Adelakun | 242/598.6 |
| 6,568,625 | B2 | 5/2003 | Faulks et al. | |
| 6,659,391 | B1 | 12/2003 | Faulks et al. | |
| 6,827,309 | B1 | 12/2004 | Newman et al. | |
| 7,011,272 | B2 | 3/2006 | Faulks et al. | |
| 2002/0036208 | A1 | 3/2002 | Faulks et al. | |
| 2002/0096596 | A1 * | 7/2002 | Adelakun | |
| 2007/0221778 | A1 * | 9/2007 | Gullo | 242/598.6 |

* cited by examiner

*Primary Examiner*—William A Rivera
(74) *Attorney, Agent, or Firm*—Richard L. Miller

(57) ABSTRACT

A dispenser for readily attaching to a roll-type toilet-tissue holder and dispensing moist towelettes from a roll of the moist towelettes. The roll-type toilet-tissue holder is disposed in a wall and has a spindle that is axially spring loaded to facilitate insertion into and removal from the roll-type toilet-tissue holder. The dispenser includes a container. The container contains the roll of the moist towelettes to prevent dehydration thereof prior to dispensing, dispenses the moist towelettes from the roll of the moist towelettes contained in the container, and has the spindle of the roll-type toilet-tissue holder pass freely therethrough and attach to the roll-type toilet-tissue holder so as to allow the container to readily attach to the roll-type toilet-tissue holder.

11 Claims, 2 Drawing Sheets

DISPENSER FOR READILY ATTACHING TO A ROLE-TYPE TOILET-TISSUE HOLDER AND DISPENSING MOIST TOWELETTES FROM A ROLE

1. CROSS REFERENCE TO RELATED APPLICATIONS

The instant application is a refile of application Ser. No. 07/833,912, filed on Feb. 11, 1992, entitled MOIST TOWELETTES DISPENSER, and incorporated herein by reference thereto.

2. BACKGROUND OF THE INVENTION

A. Field of the Invention

The embodiments of the present invention relate to a dispenser for dispensing moist towelettes, and more particularly, the embodiments of the present invention relate to a dispenser for readily attaching to a roll-type toilet-tissue holder and dispensing moist towelettes from a roll of the moist towelettes.

B. Description of the Prior Art

Numerous innovations for containers have been provided in the prior art that will be discussed below, which are in chronological order to show advancement in the art, and which are incorporated herein by reference thereto. Even through these innovations may be suitable for the specific individual purposes to which they address, however, they differ from the embodiments of the present invention in that they do not teach a dispenser for readily attaching to a roll-type toilet-tissue holder and dispensing moist towelettes from a roll of the moist towelettes.

(1) U.S. Pat. No. 573,563 to Yeakel

U.S. Pat. No. 573,563 issued to Yeakel on Dec. 22, 1896 in class 223 and subclass 106 teaches a spool holder including a casing having a closed and an open end and a longitudinally extending slot with a widened end, a spool-holding spindle secured to the closed end of the casing, a cap for the open end of the casing, a cutter on the cap, and spring on the spindle adapted to press the spool in the direction toward the cutter. The widened end of the casing is adjacent to the cutter.

(2) U.S. Pat. No. 2,649,255 to Smallen

U.S. Pat. No. 2,649,255 issued to Smallen on Aug. 18, 1953 in class 242 and subclass 598.4 teaches a cover for a wall recess mounted toilet tissue roll assembly having a center rod, including a substantially semi-cylindrical shell, end walls on the shell, axially aligned slots formed in the end walls and adapted to rotatably receive the center rod whereby the shell may be pivotally mounted thereon, a spring member secured to the shell adjacent one edge of the shell, and projecting from the surface thereof a projecting lug formed adjacent the other edge of the shell whereby the spring member and the lug abut against the wall face surrounding the recess to thereby lock the shell into a covering position. The spring member upon being actuated is adapted to be retracted from the abutment to permit the pivotal movement of the shell to a position within the recess to hereby uncover the roll. The projecting lug is adapted to be brought into abutment with another portion of the wall face upon the pivotal movement of the shell into the recess to thereby limit the extent of the pivotal movement of the shell.

(3) U.S. Pat. No. 3,184,053 to Eldridge

U.S. Pat. No. 3,184,053 issued to Eldridge on May 18, 1965 in class 242 and subclass 588.6 teaches a shipping and storage container for retaining a coil of relatively heavy material having a uniform width and thickness, including a box member including a pair of opposite end panels, a pair of opposite side panels, and enclosure apparatus connected to the end panels and the side panels. The side panels have axially aligned circular openings therethrough. A cylindrical central core extends between the openings. A pair of cup members extend through the openings and also within the ends of the central core to retain the central core within the box. The central core is slidably disposed within the fixed core of a coil of the heavy material, whereby the coil of material is completely suspended within the container and supported about its fixed core.

(4) U.S. Pat. No. 3,756,483 to Schraeder

U.S. Pat. No. 3,756,483 issued to Schraeder on Sep. 4, 1973 in class 225 and subclass 52 teaches a disposable apparatus for dispensing factory premoistened and pretreated wet paper towels. Paper rolls, premoistened and pretreated, variably sized and treated depending on a variety of consumers' and fabricators' intended uses are humidity sealed in inexpensive and disposable plastic cases that can be easily wall mounted on a once placed compatible mounting or be portable. Wetted paper is drawn through a tensile-loaded plastic flap designed to preserve humid and sterile conditions within the case. The exit slit is provided adjacent thereto with a protruding elongated edge cutting the paper by consumer's manual action to the desired length. The utility is the variety of inexpensive applications that the wetted and treated paper may serve, principally, toilet tissue, facial and body cleansing, washing of many other objects, such as windows, dishes, and surgical instruments.

(5) U.S. Pat. No. 3,843,017 to Harrison

U.S. Pat. No. 3,843,017 issued to Harrison on Oct. 22, 1974 in class 221 and subclass 63 teaches a dispenser for a treated perforated tissue web. The dispenser is provided with an opening for extraction of the web from the dispenser. The opening has associated therewith an interior flap that normally all but closes the opening through which the web is withdrawn thereby providing sufficient tension on the web to cause it to tear off at the perforations. A variation includes a form in which the flap completely closes and overlaps the opening in the dispenser forcing the web to travel in a tortuous path.

(6) U.S. Pat. No. 3,995,582 to Douglas

U.S. Pat. No. 3,995,582 issued to Douglas on Dec. 7, 1976 in class 118 and subclass 43 teaches a dispensing package including a toroidal container body enclosing a coreless rolled web of moisture absorbent material having free rotation about the axis of the body on body side wall areas of reduced diameter at opposite ends of a liquid reservoir. The leading end of the web is drawn through a longitudinal slot in a body side wall extending the full width of the web and through upper and lower flange lips defining with the slot a dispensing passage.

(7) U.S. Pat. No. 4,004,687 to Boone

U.S. Pat. No. 4,004,687 issued to Boone on Jan. 25, 1977 in class 206 and subclass 233 teaches a compact device attached by sliding it onto one post of a standard roll-type toilet-tissue holder for positioning a container of a material particularly usable for health care or personal hygiene purposes at that location, e.g., a material, such as prewetted or self-wetting sheets, an encapsulated liquid, a pressurized liquid, etc., and holding the container in a given number pending or during its usage.

(8) U.S. Pat. No. Des. 245,225 to Lyons

U.S. Pat. No. Des. 245,225 issued to Lyons on Aug. 2, 1977 in class D9 and subclass 60 teaches the ornamental design for a moist towel dispenser.

(9) U.S. Pat. No. 4,106,616 to Boone

U.S. Pat. No. 4,106,616 issued to Boone on Aug. 15, 1978 in class 206 and subclass 233 teaches a device readily attachable to a standard toilet-tissue dispenser of a roll type for positioning adjacent thereto in visual alignment supplemental material, such as a container of prewetted toilet sheets. The sheets are manually withdrawable from an aperture held firmly at a fixed position to assure their ready withdrawal and consistent location.

(10) U.S. Pat. No. 4,235,333 to Boone

U.S. Pat. No. 4,235,333 issued to Boone on Nov. 25, 1980 in class 206 and subclass 233 teaches a bathroom fixture for making available both conventional toilet-tissue and a supplemental material, for example, a moistening material for application to the human body, such as premoistened sheets, manually withdrawable from a container or housing component.

(11) U.S. Pat. NO. 4,239,164 to Barnsbee et al

U.S. Pat. No. 4,239,164 issued to Barnsbee et al. on Dec. 16, 1980 in class 242 and subclass 419.4 teaches a container for dispensing strip material having a light-sensitive layer on one side. A slot through which the strip material can be pulled from a roll of the material within the container has a first lip and a second lip spring-resiliently urged toward the first lip. The lips are shaped so that tension in the strip material therebetween produces a resultant force opposing the resilient force to reduce or eliminate pressure between the light-sensitive layer and the first lip.

(12) U.S. Pat. No. 4,535,912 to Bonk

U.S. Pat. No. 4,535,912 issued to Bonk on Aug. 20, 1985 in class 221 and subclass 46 teaches a towelette dispenser and vapor impervious pouch containing a roll or web of absorbent material, such as non-woven fibrous towelettes pre-moistened with a chemical-containing aqueous or other fluid solution. The pouch is sealed before use to prevent the loss of moisture from the pre-moistened towelette roll and is opened at the point of and at the time of first use. A double lid is adapted to provide a moisture seal between usages of the pre-moistened towelette while reducing dehydration of the opened towelette pouch within the dispenser. Feed slit adaptations in the lid provide for selective tearability of individual towelette portions from the roll. The dispenser is adapted to provide a low center of gravity, and the base of the dispenser can cooperatingly engage a wall-type holder. The towelette roll contains a leader adapted for ease of feeding through the feed slot upon first use. The web may be folded parallel to the longitudinal axis to provide larger towelettes and facilitate improve ease of withdrawal from the dispenser.

(13) U.S. Pat. No. Des. 285,995 to Minost

U.S. Pat. No. Des. 285,995 issued to Minost on Oct. 7, 1986 in class D6 and subclass 522 teaches the ornamental design for a paper towel dispenser.

(14) U.S. Pat. No. 6,098,836 to Gottselig

U.S. Pat. No. 6,098,836 issued to Gottselig on Aug. 8, 2000 teaches that wet towelette dispensers are provided which include a roll of moistened, flushable towelettes disposed in a sealable housing which has a slotted opening therein for permitting the removal of one more of the towelettes from the dispenser in a manner similar to the way dry toilet paper is typically dispensed. A sealing blade and receiving groove are positioned in the slotted opening to prevent the towelettes from drying. The housing may include a lid for replacing the roll of towelettes. The sealing blade may further be positioned along the edge of the lid and a groove positioned along the housing to seal the interior compartment containing the roll of towelettes.

(15) U.S. Patent Office Document No. 2002/0036208 A1 to Faulks et al.

U.S. Pat. Office Document No. 2002/0036208 A1, Published to Faulks Et Al. on Mar. 28, 2002, teaches that there is provided a system and apparatus for dispensing wet wipes. The system may include a wiper assembly, which may include a chassis, a wiper blade, and a tensioner. The wiper assembly minimizes the amount of wipes which cannot be dispensed. The wiper assembly may be mounted to a dispenser for wipes.

(16) U.S. Pat. No. 6,568,625 B2 to Faulks et al.

U.S. Pat. No. 6,568,625 B2 issued to Faulks et al. on May 27, 2003, teaches that there is provided a mounting system for an apparatus for dispensing wet wipes. The system may include a dispenser and a mounting bracket. The dispenser has the ability to be mounted to a conventional toilet tissue holder. The mounting bracket may securely yet removably hold the dispensing apparatus to the holder.

(17) U.S. Pat. No. 6,659,391 B1 to Faulks et al.

U.S. Pat. No. 6,659,391 B1 issued to Faulks et al. on Dec. 9, 2003, to Faulks Et Al. teaches that there is provided a method for dispensing wet wipes. The method may include mounting a dispenser, inserting a container of wet wipes, threading the wipes through the dispenser, and separating a portion of wipes. The container may have the ability to be inserted into the dispenser in a pre-selected manner based on the desired orientation of the wipes contained therein.

(18) U.S. Pat. No. 6,827,309 B1 to Newman et al.

U.S. Pat. No. 6,827,309 B1 issued to Newman et al. on Dec. 7, 2004, teaches that there is provided a mounting system for an apparatus for dispensing wet wipes. The system may include a dispenser, a mounting assembly, a backing plate, and arms. The dispenser has the ability to be mounted to a surface by applied pressure or by conventional fastening. The mounting assembly may securely yet removably hold the dispensing apparatus to the surface.

(19) U.S. Pat. No. 7,011,272 B2 to Faulks et al.

U.S. Pat. NO. 7,011,272 B2 issued to Faulks et al. on Mar. 24, 2006, that there is provided a system and apparatus for dispensing wet wipes. The system may include a wiper assembly, which may include a chassis, a wiper blade, and a tensioner. The wiper assembly minimizes the amount of wipes which cannot be dispensed. The wiper assembly may be mounted to a dispenser for wipes.

It is apparent that numerous innovations for containers have been provided in the prior art that are adapted to be used. Furthermore, even through these innovations may be suitable for the specific individual purposes to which they address, however, they would not be suitable for the purposes of the embodiments of the present invention as heretofore described, namely, a dispenser for readily attaching to a roll-type toilet-tissue holder and dispensing moist towelettes from a roll of the moist towelettes.

3. SUMMARY OF THE INVENTION

Thus, it is an object of the present invention to provide a dispenser for readily attaching to a roll-type toilet-tissue holder and dispensing moist towelettes from a roll of the moist towelettes that avoids the disadvantages of the prior art.

Briefly stated, another object of the present invention is to provide a dispenser for readily attaching to a roll-type toilet-tissue holder and dispensing moist towelettes from a roll of the moist towelettes. The roll-type toilet-tissue holder is disposed in a wall and has a spindle that is axially spring loaded to facilitate insertion into and removal from the roll-type toilet-tissue holder. The dispenser includes a container. The container contains the roll of the moist towelettes to prevent dehydration thereof prior to dispensing, dispenses the moist towelettes from the roll of the moist towelettes contained in the container, and has the spindle of the roll-type toilet-tissue holder pass freely therethrough and attach to the roll-type toilet-tissue holder so as to allow the container to readily attach to the roll-type toilet-tissue holder.

The novel features consider characteristic of the present invention are set forth in the appended claims. The embodiments of the present invention themselves, however, both as to their construction and to their method of operation together with additional objects and advantages thereof will be best understood from the following description of the specific embodiments when read and understood in connection with the accompanying drawing.

4. BRIEF DESCRIPTION OF THE DRAWING

The figures of the drawing are briefly described as follows.

5. LIST OF REFERENCE NUMERALS UTILIZED IN THE DRAWING

A. General

Figure 1:
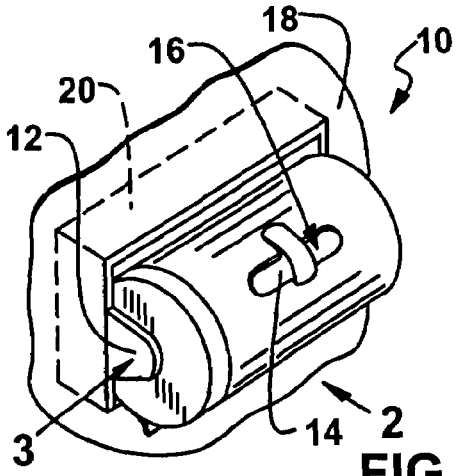
FIG. 1 is a diagrammatic perspective view of the dispenser of the embodiments of the present invention readily attaching to a roll-type toilet-tissue holder and dispensing moist towelettes from a roll of the moist towelettes.

10 dispenser of embodiments of present invention for readily attaching to roll-type toilet-tissue holder 12 and dispensing moist towelettes 14 from roll 16 of moist towelettes 14

12 roll-type toilet-tissue holder 12

14 moist towelettes from roll 16

16 roll

18 wall

20 spindle of roll-type toilet-tissue holder 12

B Configuration Of Dispenser 10

22 container for containing roll 16 of moist towelettes 14 to prevent dehydration prior to dispensing, for dispensing moist towelettes 14 from roll 16 of moist towelettes 14 contained in container 22, and is for having spindle 20 of roll-type toilet-tissue holder 12 pass freely therethrough and attach to roll-type toilet-tissue holder 12 so as to allow container 22 to readily attach to roll-type toilet-tissue holder 12

24 back wall of container 22

26 front wall of container 22

28 longitudinal side wall of container 22

30 longitudinal center line of container 22

32 through bore in back wall 24 of container 22 for having spindle 20 pass freely therethrough

34 perimeter defining through bore 32 in back wall 24 of container 22

36 through bore in front wall 26 of container 22 for having roll 16 of moist towelettes 14 enter therethrough

38 perimeter of through bore 36 in front wall 26 of container 22

40 neck of front wall 26 of container 22

42 tube of container 22 for being received by rigid core 17 of roll 14 of moist towelettes 16

44 terminal end of tube 42 of container 22

46 groove in terminal end 44 of tube 42 of container 22

48 through slot in container 22 for having towelettes 14 contained in container 22 dispenser therethrough

50 door of container 22 for maintaining moisture of roll 14 of moist towelettes 16 contained in container 22

52 living hinge of door 50 of container 22

54 circumferential portion of door 50 of container 22

56 axially portion of door 50 of container 22

58 cap for maintaining roll 14 of moist towelettes 16 in container 22

60 through bore in cap 58

62 perimeter of through bore 60 in cap 58

64 stub tube of cap 58

66 plurality of protrusions of cap 58

68 flap of container 22 for abutting against wall 18

70 stop of flap 68 of container 22

6. DETAILED DESCRIPTION OF THE PREFERRED EMBODIMENTS

A. General

Figure 2:
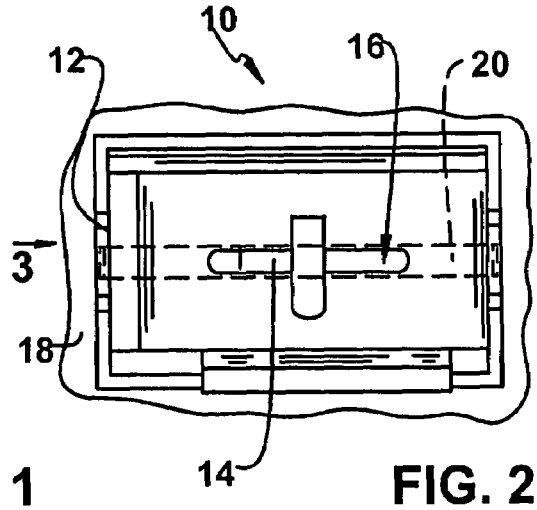
FIG. 2 is an enlarged diagrammatic front end view taken generally in the direction of ARROW 2 in FIG. 1.
Figure 3:
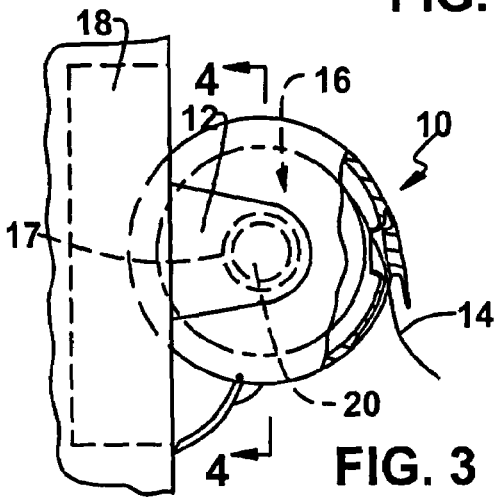
FIG. 3 is an enlarged diagrammatic side elevational view taken generally in the direction of ARROW 3 in FIG. 2.

Referring now to the figures, in which like numerals indicate like parts, and particularly to FIGS. 1-3, which are, respectively, a diagrammatic perspective view of the dispenser of the embodiments of the present invention readily attaching to a roll-type toilet-tissue holder and dispensing moist towelettes from a roll of the moist towelettes, an enlarged diagrammatic from end view taken generally in the direction of ARROW 2 in FIG. 1, and an enlarged diagrammatic side elevational view taken generally in the direction of ARROW 3 in FIG. 2, the dispenser of the embodiments of the present invention is shown generally at 10 for readily attaching to a roll-type toilet-tissue holder 12 and dispensing moist towelettes 14 from a roll 16 of the moist towelettes 14. The roll 16 of the moist towelettes 14 has a rigid core 17. The roll-type toilet-tissue holder 12 is disposed in a wall 18 and has a spindle 20 that is axially spring loaded to facilitate insertion into and removal from the roll-type toilet-tissue holder 12 and which extends into the rigid core 17 of the roll 16 of the moist towelettes 14.

B. The Configuration of the Dispenser 10

Figure 5:
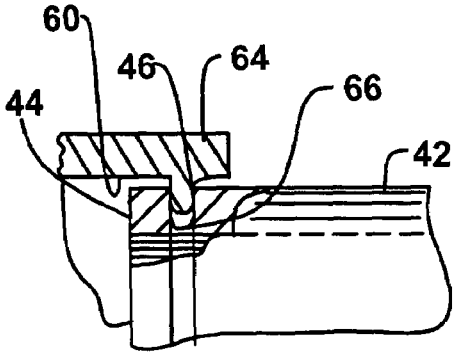
FIG. 5 is an enlarged diagrammatic fragmented view of the area generally enclosed by the dotted circle identified by ARROW 5 in FIG. 4.
Figure 4:
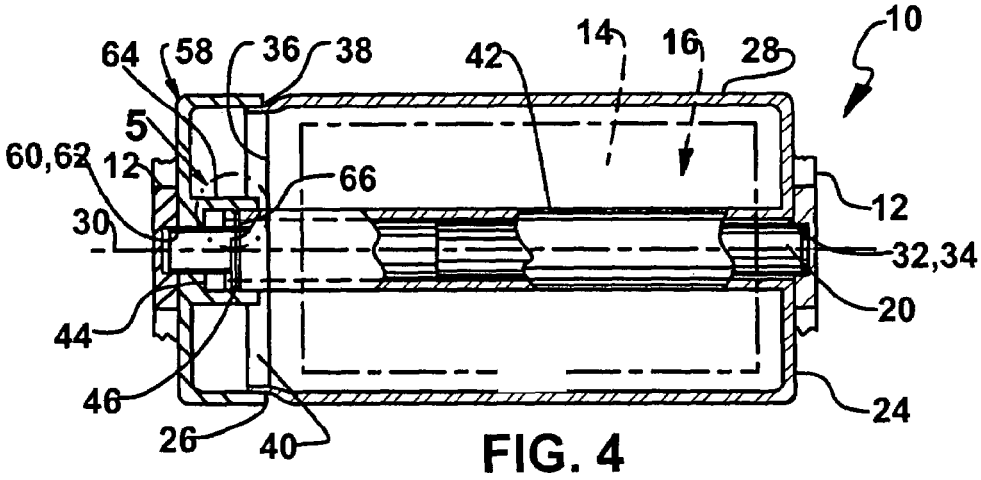
FIG. 4 is an enlarged diagrammatic cross sectional view taken along LINE 4-4 in FIG. 3.
Figure 6:
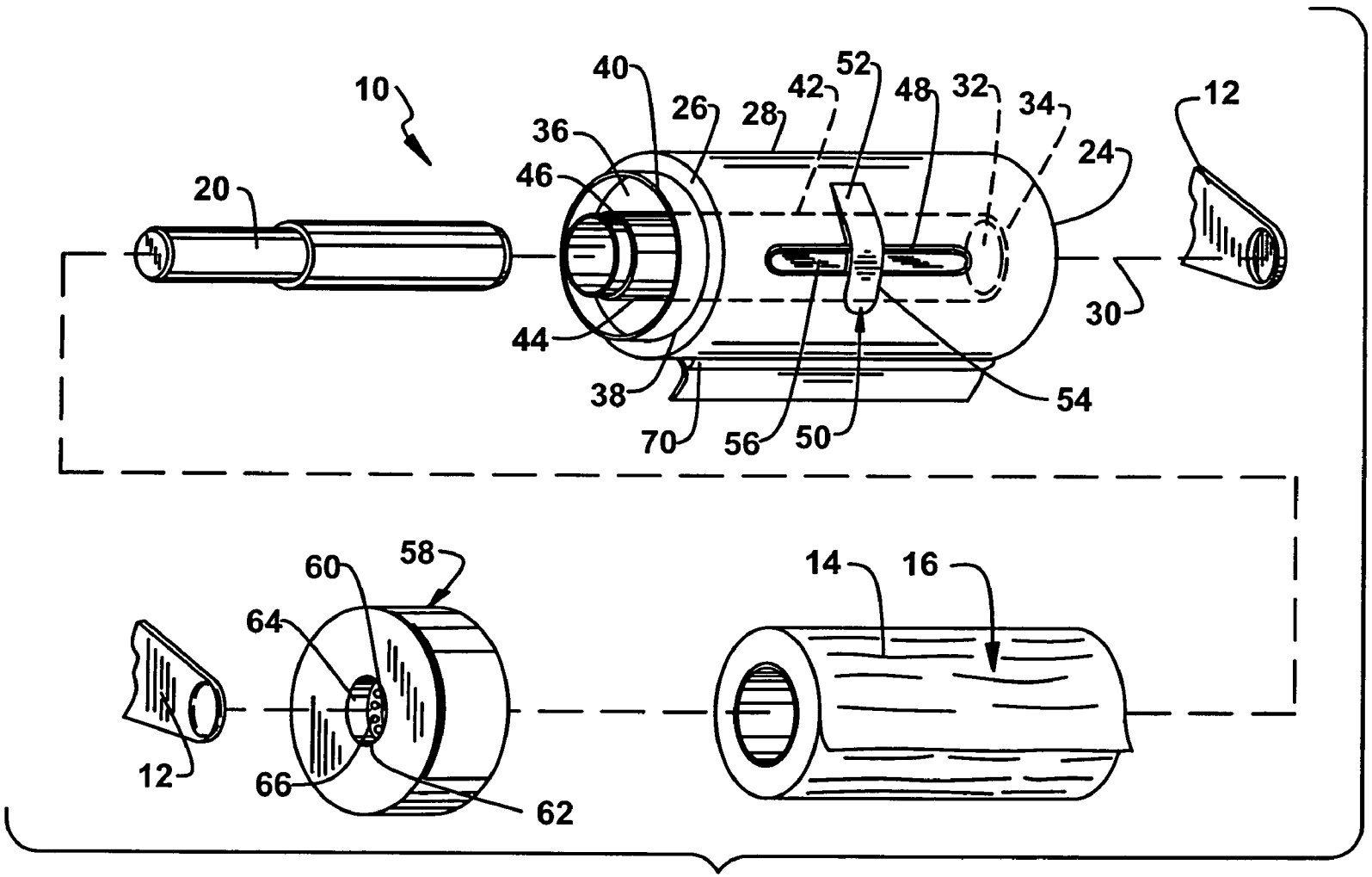
FIG. 6 is an enlarged exploded diagrammatic perspective view of the dispenser of the embodiments of the present invention shown in FIGS. 1-3.

The configuration of the dispenser 10 can best be seen in FIGS. 4-6, which are, respectively, an enlarged diagrammatic cross sectional view taken along LINE 4-4 in FIG. 3, an enlarged diagrammatic fragmented view of the area generally enclosed by the dotted circle identified by ARROW 5 in FIG. 4, and an enlarged exploded diagrammatic perspective view of the dispenser of the embodiments of the present invention shown in FIGS. 1-3, and as such, will be discussed with reference thereto.

The dispenser 10 comprises a container 22. The container 22 has a length, is for containing the roll 16 of the moist towelettes 14 to prevent dehydration prior to dispensing, is for dispensing the moist towelettes 14 from the roll 16 of the moist towelettes 14 contained in the container 22, and is for having the spindle 20 of the roll-type toilet-tissue holder 12 pass freely therethrough and attach to the roll-type toilet-tissue holder 12 so as to allow the container 22 to readily attach to the roll-type toilet-tissue holder 12.

The container 22 is generally cylindrically shaped for fitting within the roll-type toilet-tissue holder 12, and has a back wall 24, a front wall 26, a longitudinal side wall 28, and a longitudinal center line 30. The longitudinal side wall 28 of the container 22 extends from the back wall 24 of the container 22 to the front wall 26 of the container 22.

The back wall 24 of the container 22 has a through bore 32. The through bore 32 in the back wall 24 of the container 22 extends centrally therethrough, and is defined by a perimeter 34. The through bore 36 in the back wall 24 of the container 22 is of a size for having the spindle 20 pass freely therethrough.

The front wall 26 of the container 22 has a through bore 36. The through bore 36 in the front wall 26 of the container 22 extends centrally therethrough, and is defined by a perimeter 38. The through bore 36 in the front wall 26 of the container 22 is of a size for having the roll 16 of the moist towelettes 14 enter therethrough.

The front wall 26 of the container 22 further has a neck 40. The neck 40 of the front wall 26 of the container 22 extends coaxially from the perimeter 38 of the through bore 36 in the front wall 26 of the container 22.

The container 22 further has a tube 42. The tube 42 of the container 22 extends in the container 22, along the longitudinal center line 30 of the container 22, from the perimeter 34 of the through bore 32 in the back wall 24 of the container 22 to out through the through bore 38 in the front wall 36 of the container to a terminal end 44, and is of a size for being received by the rigid core 17 of the roll 14 of the moist towelettes 16.

The terminal end 44 of the tube 42 of the container 22 has a groove 46. The groove 46 in the terminal end 44 of the tube 42 of the container 22 extends circumferentially therearound.

The container 22 further has a through slot 48. The through slot 48 in the container 22 extends longitudinally along the longitudinal side wall 28 of the container 22, from just before the end wall 24 of the container 22 to just before the front wall 26 of the container 22, and is of a size for having the towelettes 14 contained in the container 22 dispense therethrough.

The container 22 further has a door 50. The door 50 of the container 22 is pivotally attached by a living hinge 52 to the longitudinal side wall 28 of the container 22, and normally closes the through slot 48 in the longitudinal side wall 28 of the container 22 for maintaining moisture of the roll 14 of the moist towelettes 16 contained in the container 22.

The door 50 of the container 22 has a circumferential portion 54 and an axial portion 56. The circumferential portion 54 of the door 50 of the container 22 is pivotally attached by the living hinge 52 of the door 50 of the container 22 to the longitudinal side wall 28 of the container 22, and extends circumferentially across the through slot 48 in the longitudinal side wall 28 of the container 22, while the axially portion 56 of the door 50 of the container 22 extends axially across the circumferential portion 54 of the door 50 of the container 22 to normally close the through slot 48 in the longitudinal side wall 28 of the container 22. The circumferential portion 54 of the door 50 of the container 22 acts as a handle to easily lift the door 50 of the container 22 from the through slot 48 in the longitudinal side wall 28 of the container 22 for dispensing the moist towelettes 14.

The dispenser 10 further comprises a cap 58. The cap 58 selectively closes the front wall 26 of the container 22, and is for maintaining the roll 14 of the moist towelettes 16 in the container 22.

The cap 58 has a through bore 60. The through bore 60 in the cap 58 extends centrally therethrough, and is defined by a perimeter 62.

The cap 58 further has stub tube 64. The stub tube 64 of the cap 58 extends axially into the cap 58, from the perimeter 62 of the through bore 60 in the cap 58, and releasably receives the terminal end 44 of the tube 42 of the container 22.

The cap 58 further has a plurality of protrusions 66. The plurality of protrusions 66 of the cap 58 are spaced-apart from each other, and extend radially inwardly from the stub tube 64 of the cap 58 to selectively engage in the groove 46 in the terminal end 44 of the tube 42 of the container 22 to maintain the cap 58 releasably to the container 22.

The container 22 further has a flap 68. The flap 68 of the container 22 depends pivotally from the container 22, extends along the longitudinal side wall 28 of the container 22, and is for abutting against the wall 18.

The flap 68 of the container 22 has a stop 70. The stop 70 of the flap 68 of the container 22 extends fixedly along the longitudinal side wall 28 of the container 22 to provide a stop for the flap 68 of the container 22 when the flap 70 of the container 22 abuts against the wall 18 thereby preventing the container 22 from rotating as the moist towelettes 14 are being pulled therefrom.

C. Conclusion

It will be understood that each of the elements described above or two or more together may also find a useful application in other types of constructions differing from the types described above.

While the embodiments of the present invention have been illustrated and described as embodied in a dispenser for readily attaching to a roll-type toilet-tissue holder and dispensing moist towelettes from a roll of the moist towelettes, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A dispenser for readily attaching to a roll-type toilet-tissue holder and dispensing moist towelettes from a roll of the moist towelettes, wherein the roll-type toilet-tissue holder is disposed in a wall and has a spindle, wherein the spindle of the roll-type toilet-tissue holder is axially spring loaded to facilitate insertion into and removal from the roll-type toilet-tissue holder, and wherein the roll of moist towelettes has a rigid core, comprising:

a container;

wherein said container is for containing the roll of the moist towelettes to prevent dehydration prior to dispensing;

wherein said container is for dispensing the moist towelettes from the roll of the moist towelettes contained in said container;

wherein said container is for having the spindle of the roll-type toilet-tissue holder pass freely therethrough and attach to the roll-type toilet-tissue holder so as to allow said container to readily attach to the roll-type toilet-tissue holder;

wherein said container has a back wall;

wherein said back wall of said container has a through bore;

wherein said through bore in said back wall of said container extends centrally therethrough;

wherein said through bore in said back wall of said container is defined by a perimeter;

wherein said through bore in said back wall of said container is of a size for having the spindle of the roll-type toilet-tissue holder pass freely therethrough wherein said container has front wall;

wherein said front wall of said container has a through bore;

wherein said through bore in said front wall of said container extends centrally therethrough;

wherein said through bore in said front wall of said container is defined by a perimeter;

wherein said through bore in said front wall of said container is of a size for having the roll of the moist towelettes enter therethrough;

wherein said front wall of said container has a neck; and wherein said neck of said front wall of said container extends coaxially from said perimeter of said through bore in said front wall of said container;

wherein said container has a tube;

wherein said tube of said container extends in said container;

wherein said container has a longitudinal center line;

wherein said tube of said container extends along said longitudinal center line of said container;

wherein said tube of said container extends from said perimeter of said through bore in said back wall of said container to out through said through bore in said front wall of said container to a terminal end;

wherein said tube of said container is of a size for being received by the rigid core of the roll of the moist towelettes;

wherein said terminal end of said tube of said container has a groove; and wherein said groove in said terminal end of said tube of said container extends circumferentially therearound.

2. The dispenser of claim 1 wherein said container is generally cylindrically shaped for fitting within the roll-type toilet-tissue holder.

3. The dispenser of claim 1, wherein said container has a longitudinal side wall;

wherein said container has a through slot;

wherein said through slot in said container extends longitudinally along said longitudinal side wall of said container;

wherein said through slot in said container extends from just before said end wall of said container to just before said front wall of said container; and wherein said through slot in said container is of a size for having the towelettes contained in said container dispense therethrough.

4. The dispenser of claim 3, wherein said container has a door;

wherein said door of said container is pivotally attached by a living hinge to said longitudinal side wall of said container; and wherein said door of said container normally closes said through slot in said longitudinal side wall of said container for maintaining moisture of the roll of the moist towelettes contained in said container.

5. The dispenser of claim 4, wherein said door of said container has:

a) a circumferential portion; and b) an axial portion;

wherein said circumferential portion of said door of said container is pivotally attached by said living hinge of said door of said container to said longitudinal side wall of said container;

wherein said circumferential portion of said door of said container extends circumferentially across said through slot in said longitudinal side wall of said container;

wherein said axially portion of said door of said container extends axially across said circumferential portion of said door of said container to normally close said through slot in said longitudinal side wall of said container; and wherein said circumferential portion of said door of said container acts as a handle to easily lift said door of said container from said through slot in said longitudinal side wall of said container for dispensing the moist towelettes.

6. The dispenser of claim 3 wherein said container has a flap;

wherein said flap of said container depends pivotally from said container;

wherein said flap of said container extends along said longitudinal side wall of said container; and wherein said flap of said container is for abutting against the wall.

7. The dispenser of claim 6, wherein said flap of said container has a stop; and wherein said stop of said flap of said container extends fixedly along said longitudinal side wall of said container to provide a stop for said flap of said container when said flap of said container abuts against the wall thereby preventing said container from rotating as the moist towelettes are being pulled therefrom.

8. The dispenser of claim 1, further comprising a cap;

wherein said cap selectively closes said front wall of said container; and wherein said cap is for maintaining the roll of the moist towelettes in said container.

9. The dispenser of claim 8, wherein said cap has a through bore;

wherein said through bore in said cap extends centrally therethrough; and wherein said through bore in said cap is defined by a perimeter.

10. The dispenser of claim 9, wherein said cap has a stub tube;

wherein said stub tube of said cap extends axially into said cap;

wherein said stub tube of said cap extends from said perimeter of said through bore in said cap; and wherein said stub tube of said cap releasably receives said terminal end of said tube of said container.

11. The dispenser of claim 10, wherein said cap has a plurality of protrusions;

wherein said plurality of protrusions of said cap are spaced-apart from each other; and wherein said plurality of protrusions of said cap extend radially inwardly from said stub tube of said cap to selectively engage in said groove in said terminal end of said tube of said container to maintain said cap releasably to said container.

* * * * *